United States Patent [19]

Johnson et al.

[11] Patent Number: 4,784,205

[45] Date of Patent: Nov. 15, 1988

[54] DISPLAY SYSTEM

[76] Inventors: David B. Johnson, 3967 Hayes NE., Columbia Heights, Minn. 55421; Fredrik A. Johnson, 4135 Brunswick Ave. S., St. Louis Park, Minn. 55416; Robert R. Zuehlsdorff, 19541 E. Front Blvd., NE., Wyoming, Minn. 55092

[21] Appl. No.: 930,713

[22] Filed: Nov. 13, 1986

[51] Int. Cl.[4] ..... A47G 5/00

[52] U.S. Cl. ..... 160/351; 160/328; 160/378; 211/194

[58] Field of Search ..... 52/239, 38, 637, 645; 160/135, 351, 328, 329, 378; 182/178; 211/194

[56] References Cited

U.S. PATENT DOCUMENTS

| | | | |
|---|---|---|---|
| 454,005 | 6/1891 | Parsons et al. | 160/378 X |
| 2,554,542 | 5/1951 | Rust et al. | 160/328 |
| 3,290,014 | 12/1966 | Stapleton | 52/645 X |
| 3,583,466 | 6/1971 | Dreyer | 160/351 |
| 3,734,033 | 5/1973 | Downing | 182/178 X |
| 3,768,222 | 10/1973 | Birum, Jr. | 52/239 |
| 4,085,789 | 4/1978 | Steiver et al. | 160/135 |
| 4,373,570 | 2/1983 | Nussdorf et al. | 160/351 X |
| 4,516,620 | 5/1985 | Mulhern | 160/351 |
| 4,637,178 | 1/1987 | Nimmo et al. | 52/239 X |

*Primary Examiner*—Carl D. Friedman

*Attorney, Agent, or Firm*—Lawrence M. Nawrocki

[57] ABSTRACT

A kit for assembling a portable display system. The kit includes a plurality of H-shaped members which can be assembled one on top of the other, a flexible panel attachable to the assembled H-members and a tensioning device for tensioning the flexible panel.

8 Claims, 3 Drawing Sheets

DISPLAY SYSTEM

TECHNICAL FIELD

The present invention is related generally to the field of display backing wall construction. More narrowly, the invention is related to temporarily erected wall construction of this type. Specifically, the invention deals with a kit for erecting a temporary display backing wall system.

BACKGROUND OF THE INVENTION

Various types of temporary interior wall construction systems are known in the prior art. They can be used, among other purposes, for dividing up office space.

The specific type of interior wall construction of this invention, however, relates to a system for display purposes at, for example, a trade show. There are a number of prior art structures for use specifically as display systems for trade shows. These systems, however, are bulky and are difficult to transport from site to site.

Additionally, &he weight, in addition to the size, of display systems has been troublesome. Because they tend to be so cumbersome, portability can be virtually negated.

Also, many of these systems utilize a number of small parts to effect fastening of the components together to form the assembled system. Loss of one or more of these parts can render the display system unassemblable. This might be true even after a cumbersome display had been transported to the trade show site and the inconveniences associated with transportation had been endured.

When employing display systems such as ones to be used at, for example, trade shows, the time involved in erecting and disassemblying the system is an important consideration. It is desirable, therefore, that any system to be employed for display purposes take only a minimal time to be set up.

Another problem existent with many systems currently in use is one of providing a backdrop which is aesthetically pleasing, taut, and of a material which lends itself to having displays applied thereto. Of particular importance is the feature whereby the backdrop is maintained taut so that items to be affixed thereto can be applied easily and with assurance that they will remain affixed.

Prior art solutions to this problem have, typically, employed a rigid or semi-rigid backing to which the material is applied. These panels then are, in turn, mounted to a framework and function as the backdrop.

Such a solution has, however, fairly significant drawbacks. As previously indicated, many systems known in the art, while being held out as being "portable", are not truly so because of their excessive sizes and weights. When the solution typically employed to assure rigidity, as discussed above, is employed, the already existent excessive bulk drawback is aggravated.

It is to these problems of the prior art that the invention of the present application is directed. It is a simple to construct, compact, light-weight and versatile kit for forming a display system.

SUMMARY OF THE INVENTION

The present invention is a kit for constructing a portable display backing system. The kit includes a base for supporting a support frame structure. Further, the kit includes a plurality of generally H-shaped members.

The members are matable one to another in order to create a framework for the display system. In turn, the matable generally H-shaped members are mountable to the base so that they can be maintained, in an assembly, at a desired angle relative to a support surface on which the assembly is to be posited.

Each generally H-shaped member can include a pair of generally parallel legs and a cross-bar interconnecting the legs. In a preferred embodiment, legs of one member are substantially coextensive. That is, neither end of either leg extends beyond a corresponding end of a related leg in the same member. Parallel legs of one member are, in that preferred embodiment, interconnected by a cross-bar which extends substantially transversely to the legs.

If desired, the legs and cross-bars of the various of the plurality of generally H-shaped members can be formed of tubular stock. The stock can be similarly dimensioned from member to member to facilitate mating, and it is envisioned that the stock would be square in cross-section. It will be understood, however, that stock thusly configured is not exclusive and that, for example, circular stock could be employed.

In order to facilitate mating, means are provided to render one generally H-shaped member connectable to another. In the preferred embodiment, such means takes the form of a joint key extending from one end of each of the substantially parallel legs of each of the H-shaped members. The joint key is, in turn, receivable into a leg of another generally H-shaped member to which a particular leg is to be mated.

At least one segment of flexible back-drop material can be provided to serve as a surface to which displays can be affixed. The segment or segments can be attached to an assembly of the generally H-shaped members to drape downwardly over at least a portion of that assembly.

Typically, an assembly of the H-shaped members would be constructed as a generally planar skeleton or as a tower that would be square in cross section. It will be understood, however, that zig-zag patterns could be employed.

In any case, however, each segment of back-drop material would, it is envisioned, be provided with a width substantially the same as the distance between parallel legs of one member, on center. The length of a segment of material could vary depending upon the intended height of the framework to be constructed. That height is, of course, a function of the number of generally H-shaped members which are mated together.

A segment of backdrop material can carry, at its upper end, means for connecting the segment to the assembly of H-shaped members and, typically, at the upper end of the uppermost member. The segment, thereafter, drapes downwardly to cover a portion of the framework assembly. In the preferred embodiment, the lower end is provided with a lip along its length.

In order to render the assembly of generally H-shaped members mounted to a base and overlying segments of backdrop material able to viably function as a display system, means can be provided for tensioning the display backdrop material so that mounting of display items can be effected easily and effectively. The tensioning means can include at least one finger mounted to a leg of an H-shaped member adjacent one end of the lip at the bottom of a backdrop material segment. Typically, two fingers would be provided, one at either end of the lip.

The fingers provided, it is intended, would be flexible and would be provided, at their lower ends, with catch means configured to receive and capture therein the lip of the segment. Lower ends of the fingers, therefore, extend, when the fingers are unflexed, downardly beyond the lip of the segment of backdrop material.

The fingers are mounted to their respective H-shaped member legs for pivoting about respective axes which are generally parallel to a plane defined by the segment of the material. The fingers can, thereby, be pivoted toward the material to capture the lip within the catch means.

Once the lip is so captured, the fingers can be pivoted back to orientations wherein longitudinal axes thereof are aligned parallel to axes of the legs to which the fingers are mounted. Means can be provided for locking the fingers in such orientations to hold the segment with which they cooperate taut against the legs to which the fingers are pivotally mounted.

Another feature of the invention is one wherein the generally H-shaped members can be nested together for compactness during storage and transportation. Such a feature is achieved by configuring the members with their cross-bars offset from a plane defined by respective legs of the members.

The present invention is, therefore, improved apparatus comprising a kit for erecting a portable display system. More specific features and advantages obtained in view of those features will become apparent with reference to the DETAILED DESCRIPTION OF THE INVENTION, appended claims, and accompanying drawing figures.

DETAILED DESCRIPTION OF THE INVENTION

Figure 1:
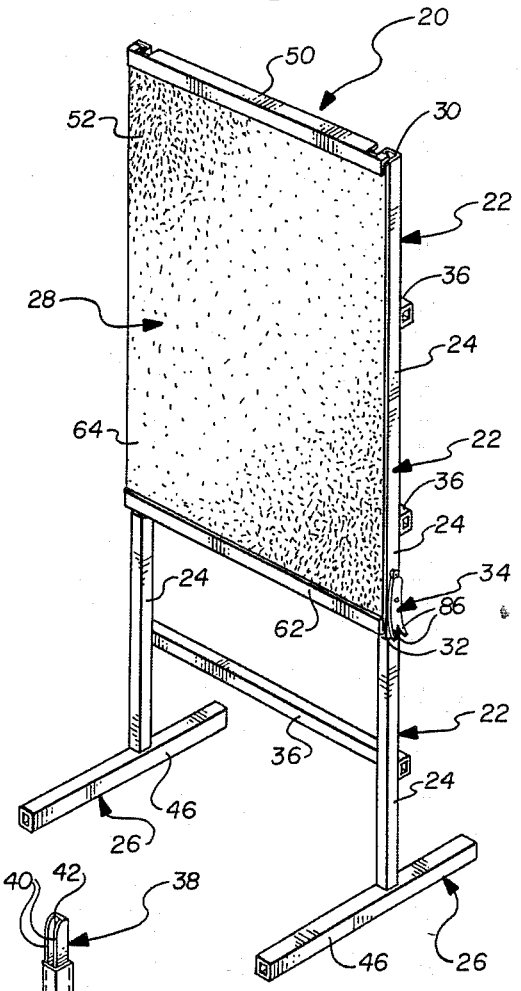
FIG. 1 is a perspective view of an assembled framework comprising a plurality of mated generally H-shaped members extending upwardly from base mounting feet, the framework having a tensioned segment of back-drop material overlying a portion of the framework thereby constructed.

Referring now to the drawings wherein like reference numerals denote like elements throughout the several views, FIG. 1 illustrates an assembled display system 20 utilizing a kit in accordance with the present invention. The display system 20 illustrated utilizes a plurality of generally H-shaped members 22 which are mated together with related, generally parallel legs 24 aligned along common axes. The system illustrated in FIG. 1 is shown as employing three of those members 22, although more or less would be appropriate, depending upon the desired configuration of the system.

The lowermost of the three members 22 is, in turn, mated to a pair of feet 26 which comprise a base for affording stability to the overall system 20. The feet 26 extend sufficiently far on either side of a plane defined by the framework assembly so that, regardless of the height to which H-shaped members 22 are stacked, stability will be maintained.

A backdrop material segment 28 is shown as overlying a portion of the framework assembly. The fabric segment's width is substantially the same as the distance between the legs 24 of the H-shaped member 22, on center. The length of the material segment 28 is substantially the same as the distance from the top 30 of the uppermost of the elements 22 to the bottom 32 of the center of the elements 22.

A plurality of resilient fingers 34 are pivotally mounted to the center of the elements 22 adjacent the bottom edge 32 of the backdrop material segment 28. These fingers 34 can, when square tubing stock is employed as is envisioned, be pivotally mounted to three of four outwardly facing surfaces of the tubing. The only surface to which a finger 34 would not be mounted would be the one facing in the same direction as does the backdrop material segment 28. The purpose of these fingers 34 will be discussed hereinafter.

Figure 2:
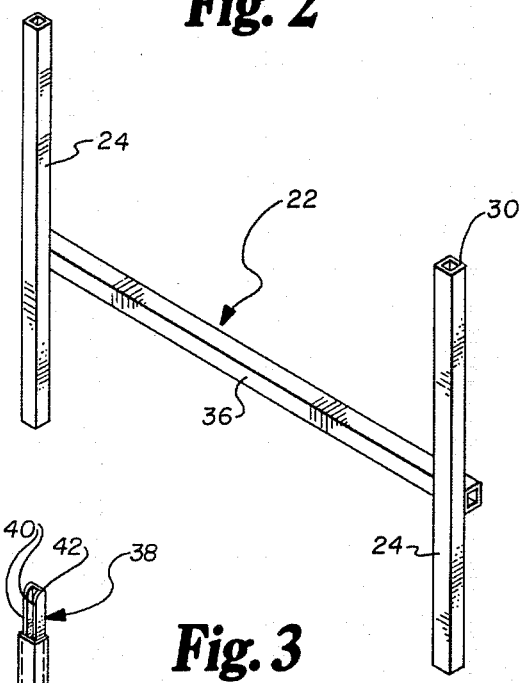
FIG. 2 is a perspective view of an H-shaped member which would, typically, be at the top of the framework.
Figure 3:
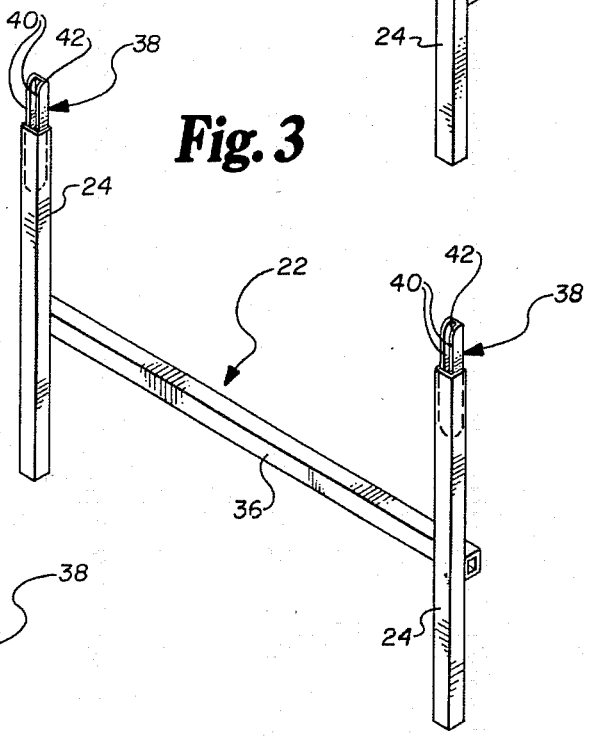
FIG. 3 is a perspective view of such an element that would, typically, be immediately mated to the base feet.
Figure 4:
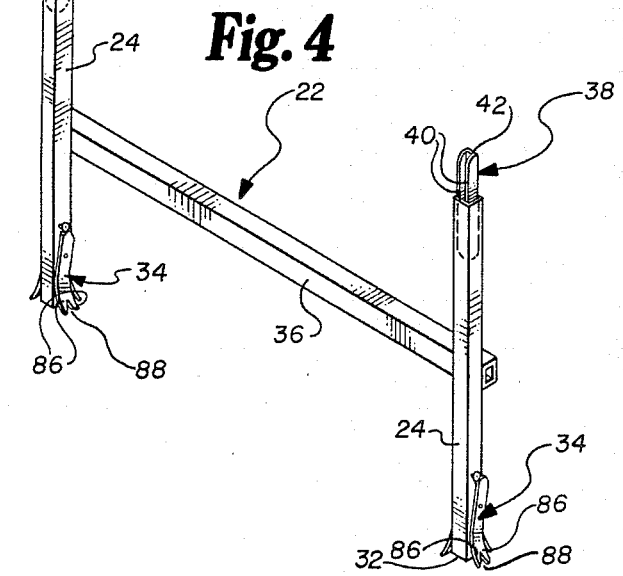
FIG. 4 is a perspective view of such an element that would, typically, be interposed between the elements of FIGS. 2 and 3.

Referring now to FIGS. 2, 3, and 4, uppermost, lowermost, and center H-shaped of the members 22, respectively, are illustrated. The construction of the various members 22 is basically the same. Each member 22 comprises a pair of generally parallel legs 24. In order to facilitate mating with other members 22, these legs 24 would be coextensive. That is, corresponding ends of the legs 24 comprising a single H-shaped member 22 would not extend beyond one another.

The members 22 are spaced from one another and are maintained in parallel orientations by an interconnecting cross-bar 36. Typically, the cross-bar 36 would be substantially transverse to the legs 24 it interconnects. Additionally, it is disposed generally midway between the ends of those legs 24.

As previously indicated, FIG. 2 illustrates a member 22 which is intended to be an uppermost of the members 22 in an assembled framework. While the members 22 illustrated in FIGS. 3 and 4 have joint keys 38 for mating members 22 together received, and securely held, in upper ends of their legs 24, the member 22 of FIG. 2 does not. As will be apparent in view of this disclosure, since an additional member is not to be extended above the member 22 of FIG. 2, such joint keys 38 would not be needed.

Figure 6:
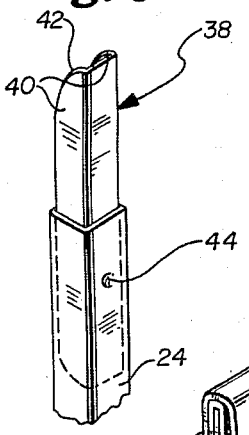
FIG. 6 is a perspective view of an upper end of an H-shaped member with a joint key extending therefrom.

The members 22 of FIGS. 3 and 4, however, are provided with such keys 38. FIG. 6 illustrates the end of a leg 24 carrying such a key 38. As seen in that figure, the key 38 can comprise a generally U-shaped channel, the ends of the arms 40 of the channel being made arcuate as at 42 in order to facilitate entry into a leg 24.

One end of the key 38 is, at some time prior to assembling a display system as illustrated in FIG. 1, inserted into one end of a leg 24 and maintained either permanently or semi-permanently therein. This can be accomplished by providing registrable dimples 44 which, when registered, preclude relative movement.

An additional difference between the member 22 illustrated in FIG. 4 and those illustrated in both FIGS. 2 and 3 is the presence of the flexible fingers 34. As previously indicated, the purpose and function of those fingers 34 will be discussed hereinafter and, specifically, with reference to FIGS. 10 and 11.

Figure 5:
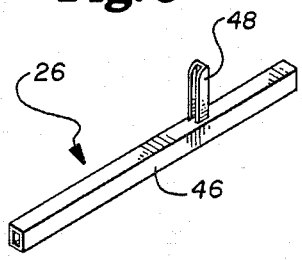
FIG. 5 is a perspective view of a base foot.

FIG. 5 illustrates a foot element 26 for supporting the mated H-shaped members 22. As previously discussed, a transverse bar 46 is employed to provide stability for the display system.

At a point along the transverse bar 46 an upwardly extending joint key 48 is affixed. It is envisioned that this key 48 would be perpendicular to the foot bar 46 so that the assembled H-shaped member 22 framework would be generally vertically oriented. It will be understood, however, that such a configuration is not exclusive.

Figure 7:
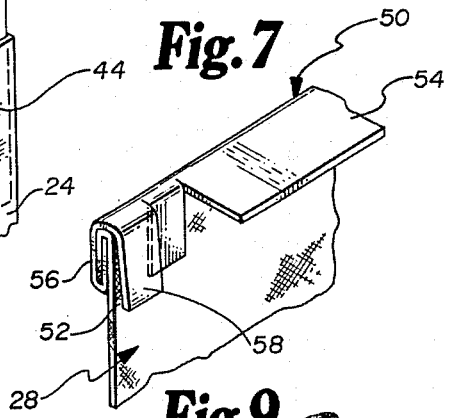
FIG. 7 is a perspective view of a portion of a backdrop material segment illustrating means for connecting the segment to an uppermost H-shaped member.
Figure 8:
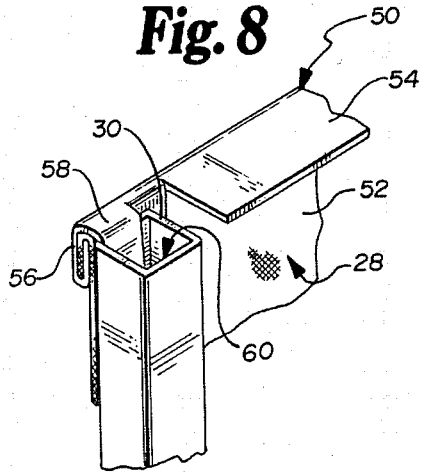
FIG. 8 is a perspective view, similar to that of FIG. 7, showing the connecting means cooperating with a leg of an H-shaped member.

FIGS. 7 and 8 illustrate an upper metal member 50 which borders the backdrop material segment 28 on its upper end 52. The member 50 includes a planar portion 54 which defines a plane generally transverse to a plane defined by the segment proper 28. A portion 56 of the member 50 generally transverse to the planar segment is crimped around the upper edge 52 of the material segment 28 to secure the member 50 to the segment 28 of material.

An end of the upper metal member 50 on the side of the material segment 28 opposite that of the crimping 56 is bent downwardly to form a tongue 58. The tongue 58, as seen in FIG. 8, can be received in a channel 60 of the upper end of one of the legs 24 of the uppermost H-shaped member 22. A tongue 58 at the opposite end of the metal member 50 can be received in the corresponding leg 24 of the H-shaped member 22. The segment 28 can, thereby, be connected to the assembly of mated H-shaped members 22 at the upper end thereof and allowed to drape downwardly.

Figure 9:
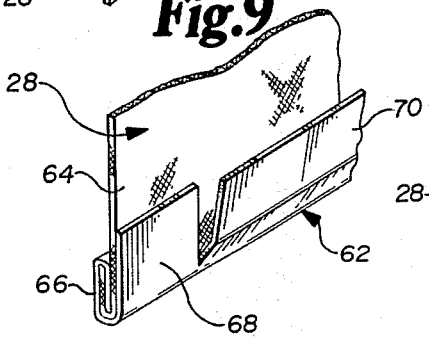
FIG. 9 is a perspective view illustrating one end of the lip carried by the bottom of the back-drop material segment.

FIG. 9 illustrates a lower metal member 62 which defines the lower edge of the backdrop material segment 28. The lower member 62 is similar in construction to the upper member 50. A transverse planar portion is not, however, provided.

While the member 62 is crimped to the edge 64 of the segment 28 as at 66, a back portion 68 of the member 62 is, at a short distance from the end thereof, flared away from the segment 28. A lip 70 which can be captured in catch means at the lowermost end of the flexible fingers 34 is, thereby, defined.

Figure 10:
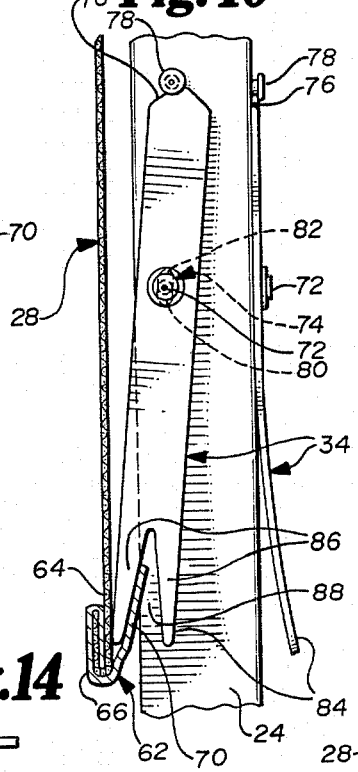
FIG. 10 is a side elevational view illustrating a flexible finger pivotally mounted to one end of an H-shaped member with a lower end thereof having catch means capturing the lip of the backdrop material segment.
Figure 11:
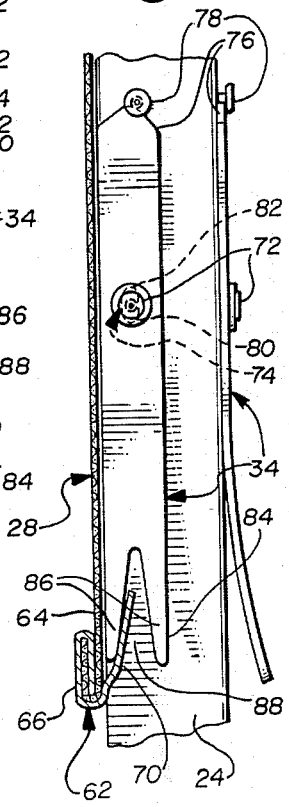
FIG. 11 is a view, similar to that of FIG. 10, but with the finger locked into position aligned with the H-shaped element leg to which it is pivotally mounted so that the segment of backdrop material is taut against the framework.

Referring now to FIGS. 10 and 11, operation of the mechanism for tensioning the backdrop material segment 28 and locking of the tensioned segment 28 in a taut configuration is illustrated. Discussion of the operation of the tensioning mechanism will be made with reference to one of the fingers 34. It will be understood though that all of the fingers 34 operate in substantially the same fashion.

The finger 34 is configured for pivoting about a pin 72 mounted to a leg 24, the pin 72 being received in a slotted hole 74 in finger 34. The axis of pivoting of the finger 34 is oriented substantially parallel to a plane defined by the backdrop material segment 28.

The slotted hole 74 is extended along an axis which is generally aligned with a longitudinal axis of the finger 34. An upper end 76 of the finger 34 can, thereby, be moveable toward and away from a locking pin 78 which is also mounted to the leg 24.

When the pivot pin 72 is at the upper end 82 of the slotted hole 74, the upper end 76 of the finger 34 will be free to pass the locking pin 78 without obstructive engagement occurring. On the other hand, however, when the pivot pin 72 is at the lower end 80 of the slotted hole 74, the locking pin 78 will preclude the upper end 76 of the finger 34 from passing thereby.

The lower end 84 of the finger 34 is provided with a pair of tines 86, the tines 86 defining a V-shaped channel 88 therebetween. It is this channel 88 which receives and captures therein the lip 70 which forms a portion of the lower metal member 62 of the backdrop material segment 28.

After a framework of the base feet 26 and the various H-shaped members 22 is assembled, the upper edge 52 of the material segment 28 would be connected to the upper end of the assembled framework by hooking the tongues 58 into the upper ends of the uppermost H-shaped member legs 24. The applicable fingers 34 would, thereafter, be pivoted so that lower ends 84 thereof would swing outwardly. Outward movement of the lower ends 84 of the fingers 34 would be permitted until the lip 70 could be inserted into the V-shaped channel 88.

With the lip 70 thereby captured, the fingers 34 would be pivoted in a direction counter-clockwise, as viewed in FIGS. 10 and 11, and toward a position wherein an axis of elongation of the finger 34 is generally parallel to an axis of elongation of the leg 24 to which the finger 34 is pivotally mounted.

The length of the backdrop material segment 28 is, however, made such that the segment 28 resists and impedes this counter-clockwise pivoting of the finger 34. Simultaneously, it urges the finger 34 upwardly so that pivot pin 72 moves relatively downwardly within slotted hole 74 to engage the lower extremity 80 thereof. Consequently, the locking pin 78 will tend to preclude such counter-clockwise rotation also.

A person setting up the assembly will be able, however, to push the lower metal member 62 inwardly toward the legs 24 of the adjacent H-shaped member 22 until the member 62 engages those legs 24. The resiliency of fingers 34 will allow their flexure so that pivot pin 72 will be drawn, relatively, to the upper extremity 82 of the slotted hole 74. As this occurs, the finger 34 can pass the locking pin 78. The upper end 76 of the finger 34 will, thereafter, be precluded from passing locking pin 78 in a clockwise direction, and the finger 34 will generally be aligned parallel to the leg 24 of H-shaped member 22.

After upper end 76 of the finger 34 passes the locking pin 78, the pivot pin 72 will, again, ride down, relatively, in the slotted hole 74 and engage the upper extremity 82 thereof. Because of the lower metal member 62 engaging the legs 24, the finger 34 will be maintained intermediate the back side of the material segment 28 and the locking pin 78. The backdrop material segment 28 will be maintained, therefore, in a tensioned configuration.

Figure 15:
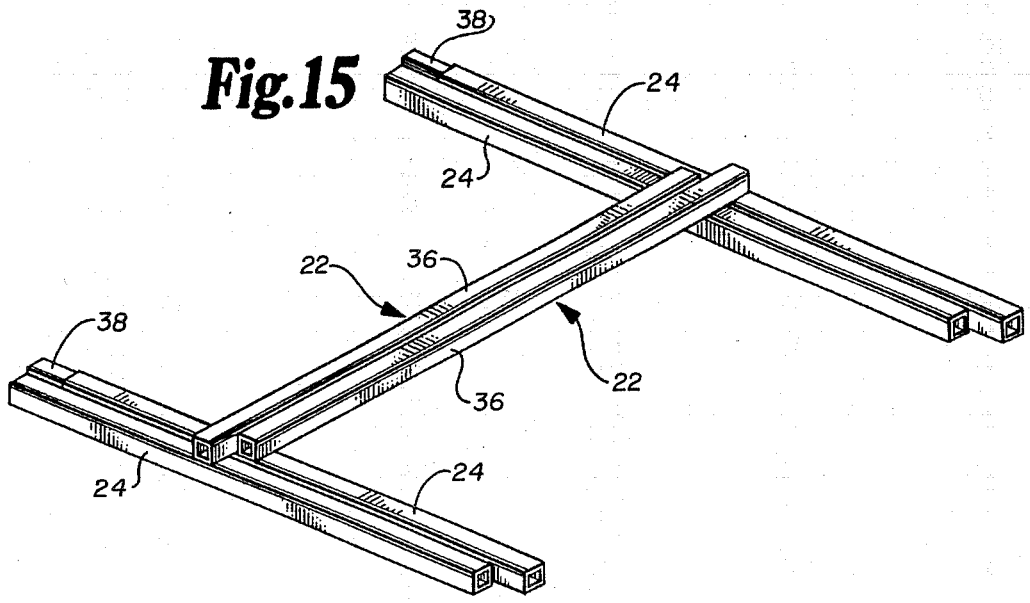
FIG. 15 is a perspective view illustrating the manner in which H-shaped elements can be nested.

FIG. 15 illustrates a feature whereby the various H-shaped members 22 can be nested together to provide a compact package during transportation. As seen in that figure, the cross-bar 36 of each member 22 can be offset from a plane defined by its corresponding parallel legs 24. As a result, the legs 24 of nested members can be allowed to lie along side and immediately adjacent one another. Similarly, the members 22 can be positioned so that the various cross-bars 36 are also along side and adjacent one another. The space taken up by the nested members 22 will not, therefore, significantly exceed that which would be occupied a single member 22 by itself.

Various materials can be employed for the framework members 22. It is envisioned, however, that, in order to make the package as light as possible yet durable, aluminum would be employed. The backdrop material segment or segments 28 would, it is envisioned, be made from a hook or pile material. Opposite and corresponding material could be used for mounting displays (not shown) to the segment 28, therefore.

One can envision other adaptions that could be employed with a kit such as the one encompassed by the present invention. For example, shelf side brackets (not shown), having portions for clamping the brackets to legs 24 of the H-shaped members 22, could be employed. Shelving could be extended across such brackets mounted to the assembly at equal heights.

Figure 12:
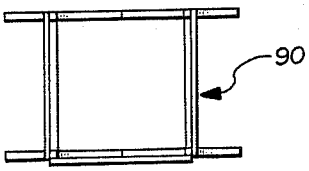
FIGS. 12–14 are schematic illustrates of different configurations of display systems.
Figure 14:
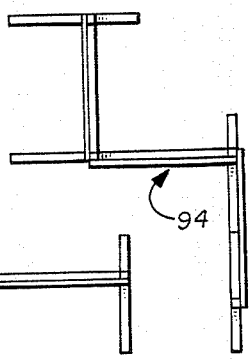
Figure 13:
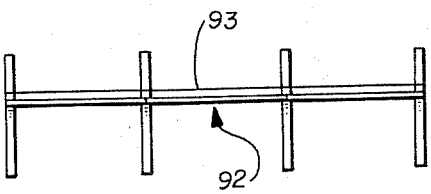

FIGS. 12, 13, and 14 are intended to illustrate various types of display systems that could be created utilizing the members 22 illustrated in FIGS. 2 through 4 and a backdrop material segment or segments 28 as previously described. The configuration of FIG. 13 can be erected by utilizing two of the assemblies as illustrated in FIG. 1. A plurality of vertically spaced cross-pieces 93 can be interposed between the two assemblies and mated to corresponding cross-bars 36 of the assemblies to define a third, intermediate portion of the framework. Each of the three portions of the framework can accommodate a separate backdrop material segment 28. It will be understood, however, that, while a square tower 90, linearly extended system 92, and a zig-zag system 94 are illustrated, the number and form of configurations are limited only by the imagination. The multiplicity of configurations available is illustrative of the flexibility of the present kit invention.

Numerous characteristics and advantages of the invention covered by this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A kit for constructing a portable display system, comprising:

(a) a plurality of generally H-shaped members, each of said members being sized and shaped substantially the same as the other of the members and including a pair of generally parallel legs defining a common plane, and a corresponding cross-bar, offset from said plane defined by associated legs, interconnecting said leg;

(b) means for mating either leg of one of said generally H-shaped members with either leg of another of said members, with mated legs aligned along an axis;

(c) means for disposing an assembly of mated generally H-shaped members wherein said assembly angles away from a surface on which the display system is to be posited; and (d) at least one segment of flexible backdrop material attachable to said assembly to drape downwardly over at least a portion thereof;

(e) wherein said generally H-shaped members can be nested together.

2. A kit for constructing a portable display system, comprising:

(a) a base;

(b) a plurality of matable, generally H-shaped members releasably securable to said base and supported thereby at an angle relative to a surface on which the display system is to be posited;

(c) a flexible panel attachable to one of said plurality of mated, generally H-shaped members and drapable downwardly therefrom;

(d) means, carried by said flexible panel at an upper end thereof, for connecting said flexible panel to one of said plurality of H-shaped members; and (e) a pair of fingers pivotably mounted to at least one of said plurality of generally H-shaped members adjacent a bottom edge of said flexible panel, when said panel is attached to one of said generally H-shaped members.

3. A kit in accordance with claim 2, said base further comprising a pair of spaced feet, each having an upwardly projecting joint key.

4. A kit in accordance with claim 2, said plurality of generally H-shaped members comprising a pair of spaced lengths of rigid tubular stock interconnected by a cross-bar formed of similar material.

5. A kit for constructing a portable display system, comprising:

(a) a plurality of generally H-shaped members, each of said members being sized and shaped substantially the same as the other of the members and including a pair of generally parallel legs and a cross-bar interconnecting said legs;

(b) means for mating either leg of one of said generally H-shaped members with either leg of another of said members, with mated legs aligned along an axis;

(c) means for disposing an assembly of mated, generally H-shaped members wherein said assembly angles away from a surface on which the display system is to be posited;

(d) at least one segment of flexible backdrop material attachable to said assembly to drape downwardly over at least a portion thereof;

(e) means, carried by each of said segments at an upper end thereof, for connecting one or more of said segments to said assembly of mated, generally H-shaped members;

(f) a lip extending along a lower end of each of said segments;

(g) a resilient tensioning finger, said finger having a lower end extending, when said finger is unflexed, downwardly beyond said lip of a segment of backdrop material draped over a related portion of said assembly, said lower end including catch means configured to receive said lip of said segment;

(h) means for mounting said finger to a leg of a generally H-shaped member adjacent said lip for pivoting about an axis generally parallel to a plane defined by said segment, wherein said finger can be pivoted to capture said lip in said catch means; and (i) means for locking said finger along said leg to which it is pivotally mounted to hold said segment taut against said leg.

6. A kit in accordance with claim 5 wherein the two legs of each generally H-shaped member are substantially coextensive, and wherein a corresponding crossbar is generally transverse to the legs.

7. A kit in accordance with claim 5 wherein said legs are made of tubular stock, and wherein said mating means comprises a joint key, receivable into a leg of a generally H-shaped member to which a leg is to be mated, extending from one end of each of said legs.

8. A kit in accordance with claim 5 wherein said disposing means angles said assembly away from the surface on which the display system is to be posited wherein said legs of said generally H-shaped members are maintained generally vertical.

* * * * *